US006494698B2

(12) United States Patent
Arnold

(10) Patent No.: US 6,494,698 B2
(45) Date of Patent: Dec. 17, 2002

(54) ROTARY PISTON MACHINE HAVING CYCLOID TEETH

(76) Inventor: Felix Michael Arnold, Pfizerstrasse 7, D-70184 Stuttgart (DE)

( * ) Notice: Subject to any disclaimer, the term of this patent is extended or adjusted under 35 U.S.C. 154(b) by 0 days.

(21) Appl. No.: 09/975,263

(22) Filed: Oct. 12, 2001

(65) Prior Publication Data

US 2002/0037228 A1 Mar. 28, 2002

Related U.S. Application Data

(63) Continuation-in-part of application No. 09/485,880, filed on Feb. 17, 2000, now abandoned.

(30) Foreign Application Priority Data

Aug. 21, 1997 (DE) ..... 197 36 397

(51) Int. Cl.[7] ..... F01C 3/08
(52) U.S. Cl. ..... 418/150
(58) Field of Search ..... 418/68, 195, 150

(56) References Cited

U.S. PATENT DOCUMENTS 2,654,322 A * 10/1953 Olsen ..... 415/66
2,831,436 A * 4/1958 Schmidt et al. ..... 418/195

FOREIGN PATENT DOCUMENTS

| | | | | |
|---|---|---|---|---|
| DE | 2639760 | * | 3/1978 | |
| DE | 3042530 | * | 6/1982 | |
| DE | 4241320 | * | 6/1993 | |
| FR | 838.270 | * | 12/1938 | |
| GB | 1099085 | * | 1/1968 | |
| JP | 58-91302 | * | 5/1983 | ..... 418/195 |

* cited by examiner

*Primary Examiner*—John J. Vrablik
(74) *Attorney, Agent, or Firm*—Paul Vincent

(57) ABSTRACT

The invention relates to a rotary piston machine which can function as a pump, compressor or motor. A cycloid power component and a correspondingly formed blocking component are in mutual engagement in said machine. The difference in the number of teeth between both components is one. The volume of the working chambers (16) thus created attains a maximum and a minimum level at each rotation owing to the synchronous rotation of said power component and blocking component.

13 Claims, 8 Drawing Sheets

ROTARY PISTON MACHINE HAVING CYCLOID TEETH

This application is a continuation in part of 09/485,880 filed on Feb. 17, 2000 abandoned the entire disclosure of which is hereby incorporated by reference.

BACKGROUND OF THE INVENTION

The invention concerns a rotary piston machine as defined by the elements of the independent claim. A rotory piston machine for use in a pump, a compressor, a turbine or motor must exhibit properties which allow its design to be precisely calculated. In dependence on the application and the fluid dynamic properties of the medium being transported or pumped, the design of the power and blocking components must be effected in such a way that effective transport performance is obtained. Moreover, the production of these components must be done by means of a tool whose proper design is important in order to minimise production costs.

In a conventional rotary piston machine (DE P 42 41 320.6; DE G 92 18 694.7; PCT/DE 92/01025), all lines of the cycloid component and the central component extending transverse to and defining the operating direction pass through the point of intersection of the axes of rotation. This limits the expansion and compression behavior of the working chambers and therefore adaptation of the rotary piston machine to various working media and fields of application. FR 838,270,GB 1,099,085 and DE 2639760 all disclose rotory piston machines having a power component and a blocking component. The power component and blocking component teeth mutually engage and are configured to have shapes generally of a conical section type (i.e. conical, circular, parabolic, ellipsoidal, or hyperbolic). These teeth shapes of prior art have the disadvantage that a plurality of contact lines occur between the blocking and power components per chamber during operation. This causes reduced efficiency in fluid transport through the chambers and complicates calculation of the pressure and flow properties of the fluid during the course of operation.

In view of these disadvantages of prior art it is the underlying purpose of the present invention to design a rotory piston machine for a pump, a compressor, a turbine or a motor having a structure which facilitates precise calculation of the flow properties of the medium in the chambers during operation in dependence on the fluid dynamic properties of that medium and which permits efficient design of a tool for producing the power and blocking components.

SUMMARY OF THE INVENTION

This purpose is achieved in accordance with the invention with a rotory piston machine having a power component whose teeth are shaped using a cycloid generator. The cycloid shape not only allows precise calculation of the properties of the rotory piston machine but also produces one line of contact per chamber between the power and blocking components which propagates monotonically through the chamber during the course of operation thereby providing efficient operation of the pump and precise determination of the action of the pump on the transport response of the fluid. The intake and output behavior of the working chambers is determined by the phase shift, to thereby reduce undesired back-flow or mixing between the intake and output working media.

According to an advantageous embodiment of the invention, the phase shift from the inner to the outer diameter is at least 360° such that the working chamber is closed off from the surroundings at least at one angular position of the first or second component.

According to a further advantageous embodiment of the invention, the amplitudes of the cycloids forming the operating surface of the cycloid component differ from one another. This allows additional freedom in designing the behavior of the working chambers.

According to a further advantageous embodiment of the invention, the working chambers are separated by a positive fit between the sides and tops of the opposing component teeth. Due to the different number of teeth, the tooth tops of the control component advance along the sides of the cycloid component teeth to essentially eliminate fluid back-flow. In addition, the control component can thereby be driven by the cycloids.

According to a further advantageous embodiment of the invention, there is no positive fit between the cycloids forming the operating surfaces of the cycloid component and the control component. The machine is then a flow machine whose characteristics are defined by the impulse and mass of the working medium. Moreover, sensitive media having characteristics impaired by compression may also be used as the working medium.

According to a further advantageous embodiment of the invention, the control channel for input of the working medium is disposed at the outer diameter, and the control channel for output of the working medium is disposed on the inner diameter of the tooth structures. During turbine or motor operation, the impulse and mass forces generated by the working medium are aligned with the direction of displacement of the working chamber. This reduces leakage losses and improves efficiency.

According to a further advantageous embodiment of the invention, the working positions of the axes of rotation of the components can be changed independently of one another. In accordance with the invention, additional pairs of toothed disk structures can be incorporated. At least one of the components has toothed gearing on its back side which cooperate with an additional rotating component having single or double teeth. This requires a radial seal between the enclosing casing and these rotating components. Drive and output may be effected in a conventional manner using shafts or toothed wheels connected to the rotating components or disposed thereon and cooperating with additional drive or output means. By changing the working positions of the rotary axes, the volume change in one component of the rotary piston machine can be advanced or retarded with respect to the other to permit graduated operation through connection of the working chambers or for mixing.

According to an advantageous embodiment of the invention, there are two cycloid or control components and the additional part is disposed between the doubled components in the form of a ring with toothed surfaces or cycloid operating surfaces. According to a further embodiment, at least two working chambers, on opposite sides of the ring, can be connected to one another. This creates e.g. a double pump or power machine, in which a control component, with teeth on both sides, is disposed between two absolutely synchronously rotating cycloid components with a number of teeth differing by one tooth from the number of teeth on the doubled components. This control component may comprise a drive or output device in dependence on whether it is a pump or a motor. Alternatively, the drive and/or output may be effected via the doubled cycloid components. The casing may serve as a stator supporting both driven cycloid components at corresponding working angles between which the control component, having sides with a number of teeth differing by one tooth, freely rotates.

According to a further advantageous embodiment of the invention, the casing or the control component has appropriate channels for the input or output of the working media, which may be optionally controlled during rotation. This precludes additional valves and also effects rinsing in the centrifugal direction.

According to a further preferred embodiment of the invention, the radial circumference of the components is spherical, and the components are guided on a corresponding spherical inner surface of the casing in a radially sealing manner. This spherical guidance permits change in the working position without creating additional sealing problems. This outer or inner radially sealing, spherical working chamber wall may be connected to the control or cycloid components and may rotate therewith to center the components with respect to each other.

In a further advantageous embodiment of the invention, the rotary piston machine is a compressor with control independent of the rotational speed effected, in particular, by changing the phase shift of the two rotating parts relative to the channels of the working media. In addition to the advantageously stable centrifugal force dependence of the moving components, the small size, and large power, the phase shift permits continuous control of the compression ratio, independent of the rotational speed. Such a compressor is particularly suitable for charging combustion engines, since they have high, widely varying rotational speeds, since the mass of the charger should be as small as possible (in particular the driven rotating masses), and since the power must be controlled independently of the rotational speed. Since several pairs of working chambers can operate in a phase-shifted manner, the valve-less control in the direction of flow (no inversion of flow) and the very high sealing quality of the working chambers, permit the inventive compressors to be used in pressure ranges currently accessible to piston machines only.

In a further advantageous embodiment of the invention, the rotary piston machine is a hydrostatic element used as a pump, motor or transmission. These applications are advantageously influenced by the extremely favorable relationship between the size and volume exchange. The simple kinematics, the rotational speed stability of the structure and the very large rinsing channel cross-sections ensure that these machines are also suitable for the highest of rotational speeds. The inner flow resistance of the machine according to the invention is extremely low. If it is used as a pump, the high inherent stability of the components has advantageous effects. Wear is limited to rubbing between the movable components. In addition, the machine is suitable for the highest working pressures. If it is used as a hydraulic motor the same advantages obtain, in particular, the small accelerated masses, the good starting behavior, and the high volume efficiency. The low construction volume and the compact manner in which the pump and the hydraulic motor can be connected is particularly advantageous for use as a hydrostatic transmission.

In a further advantageous embodiment of the invention, the rotary piston machine is a power machine or refrigerator, in particular, operating according to the Stirling principle, wherein the cooperating working chambers are phase-shifted by 90°. Two rotating cycloid components cooperate with a rotating control component to form operating chamber pairs which are each phase-shifted by 90°. One chamber is heated and the other cooled, and a regenerator is integrated into the control component. In accordance with the invention, there is no component exchange between the warm and cool regions. The walls of the cold and the warm working chambers are insulated from one another despite their close spatial proximity. An advantageous convection surface/working chamber volume ratio can be achieved due to the high inherent stability of the components forming the working chamber. One of the rotating components may be a linear generator driver for a Stirling motor or a linear motor for a Stirling refrigerator. The machine can therefore be hermetically sealed and designed for very high loading pressure with low working gas leakage loss. The phase shift defining the performance of the Stirling motor can be easily realized in this embodiment. In any event, the amount of transported heat can be regulated in such a refrigerator, irrespective of the rotational speed.

Further advantages and advantageous embodiments of the invention can be extracted from the following description, the drawing and the claims.

Embodiments of the invention are shown in the drawing and further described below.

DESCRIPTION OF THE PREFERRED EMBODIMENT

Figure 1:
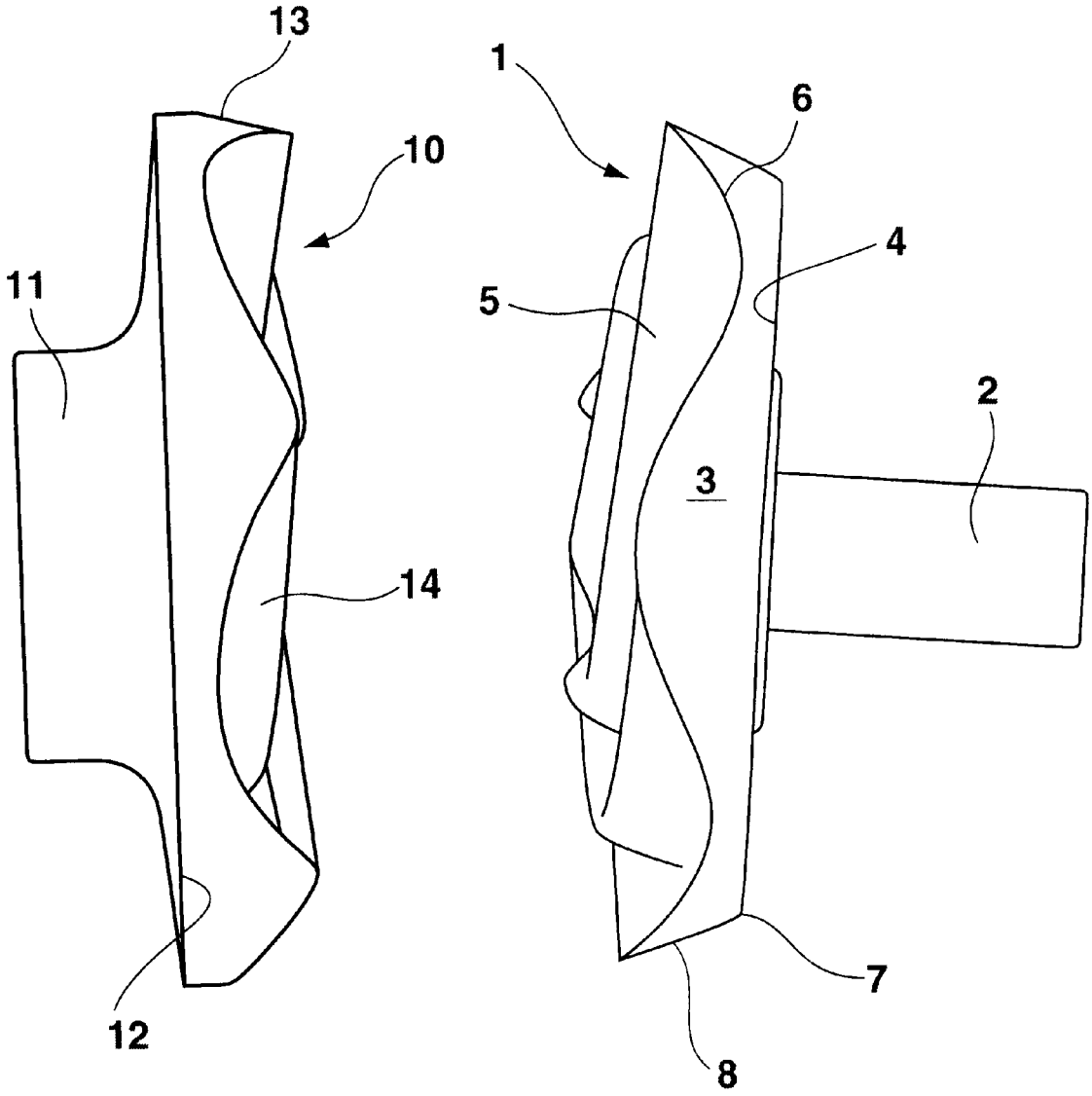
FIG. 1 shows an exploded view of a drive or output component and a blocking component.

The right hand side of FIG. 1 shows the power component 1 and the drive or output shaft 2. One end of the drive or output shaft 2 supported in the casing (not shown) is provided with the power component 1. The power component 1 consists of a spherical layer 3 which is bordered by a flat base surface 4 at the drive or output shaft 2 with an end face 5 having a spiral, cycloid toothed structure. In contrast to the conventional cycloid construction, the cycloid 6 is generated by rolling a circle along the line of intersection 7 between spherical surface 8 and base surface 4 with the point on this circle describing the cycloid 6 always being located on this spherical surface 8. The cycloid 6 is the generating curve for forming the toothed structure. A straight cycloid toothed structure is obtained by a straight generating line moving about a fixed point on the rotary axis of the drive or output shaft 2 along the generating curve 6. Instead of such a straight generating line, a spiral generating line leads to the spiral cycloid tooth structure of the power component according to the invention.

The blocking component 10 shown on the left-hand side of FIG. 1 has a similar geometrical shape. A shaft 11 disposed in the casing (not shown) supports the spherically layered blocking component 10 which is bordered by a base surface 12 proximate the shaft 11 and having a spherical outer surface 13. The end face 14 of the blocking component 10 comprises a spiral tooth structure, wherein the number of teeth exceeds the number of teeth in the cycloid 6 of the power component 1 by one. The shapes of the teeth correspond to the tangents to the cycloids 6 during the synchronous rotation of the power component 1 and the blocking component 10. The shape of the teeth may be selected to maintain a defined separation between the cycloid and the teeth of the blocking component 10. In this case, the displacement machine then becomes a flow machine. This is advantageous if e.g. the working medium could be damaged by compression at the sealing lines 9 or if the impulse and mass forces of the working medium are to be used. The rotary axes of the blocking component 10 and power component 1 are disposed at a working angle 15 with respect to one another. It is irrelevant to the invention whether the cycloid tooth structure is disposed on the end face of the power component 1 as shown herein, with the corresponding tooth structure disposed on the blocking component 10, or vice versa.

Figure 2:
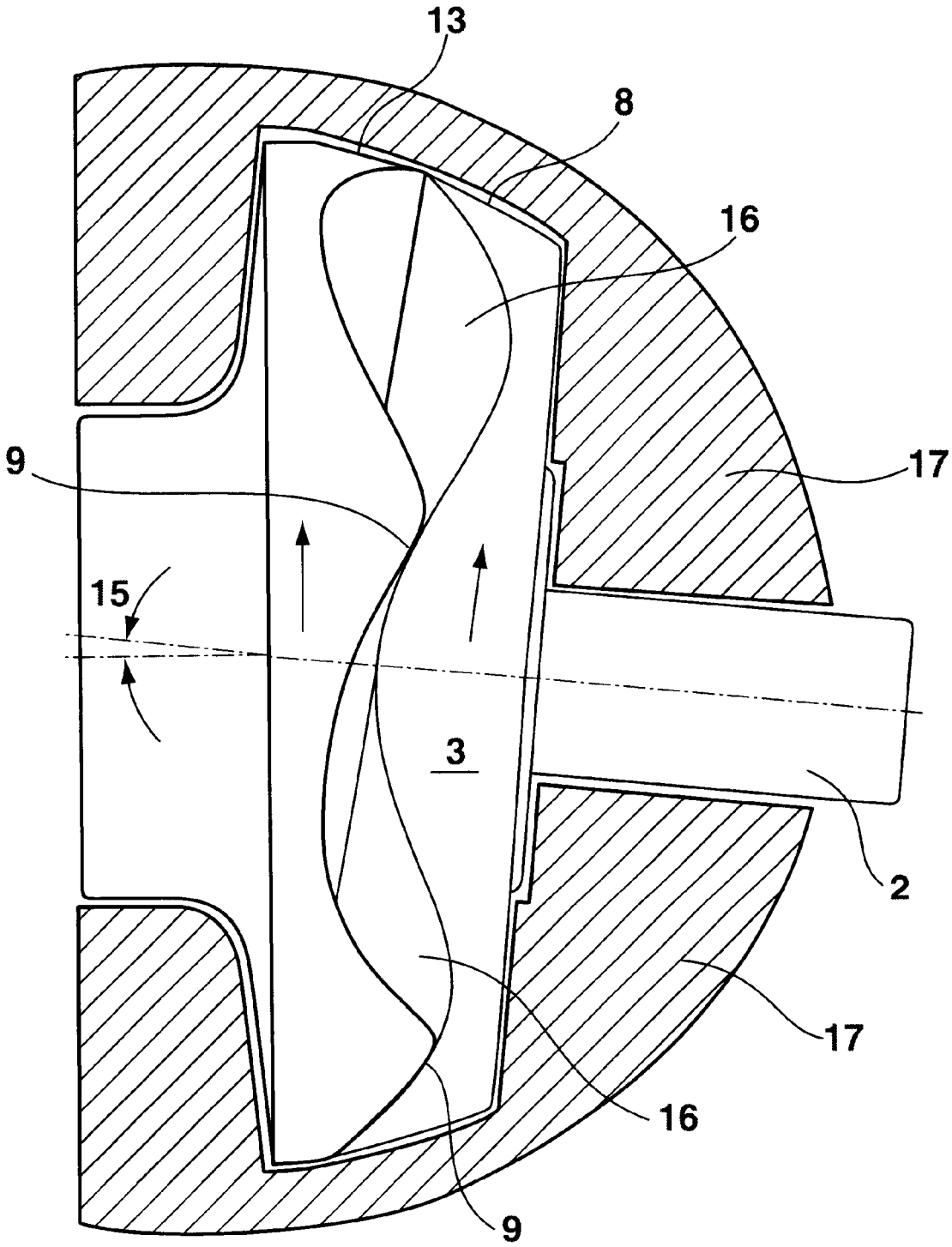
FIG. 2 shows a drive or output component and a blocking component in the assembled state, including the casing.

FIG. 2 shows the power component 1 and the blocking component 10 in their installed position. Two sealing lines 9 between the power component 1 and blocking component 10 are shown (visible as contact points in the drawing). The blocking component 10, the power component 1 and the casing 17 form several working chambers 16 in dependence on the number of cycloids, of which two are shown. In the rotational direction of the power component 1 and blocking component 10 indicated by two arrows, the working chambers 16 expand during the part of the rotary motion shown. The volume of the working chamber is correspondingly compressed in the second half of the rotation (not shown). The sealing lines 9 move from the outside to the inside or vice versa, depending on the direction of rotation, to thereby effect supply of the working medium or drive of the output shaft 2. The control openings in the casing 17 (not shown) are located in dependence on the requirements of the application. During pump operation with supply from the inside to the outside, the inlet opening in the casing 17 is located at the point where the sealing line 9 exits the inner diameter of the toothed structure. The outer toothed structure is disposed at a position in the casing leading to the required volume of the working chamber 16. The power output of the rotary piston machine may be regulated for constant rotational speed by moving the blocking component 10 relative to the power component 1. In this case, the rotary axis of the blocking component 10 remains on a cone-shaped surface having a cone angle corresponding to the working angle 15.

Figure 3:
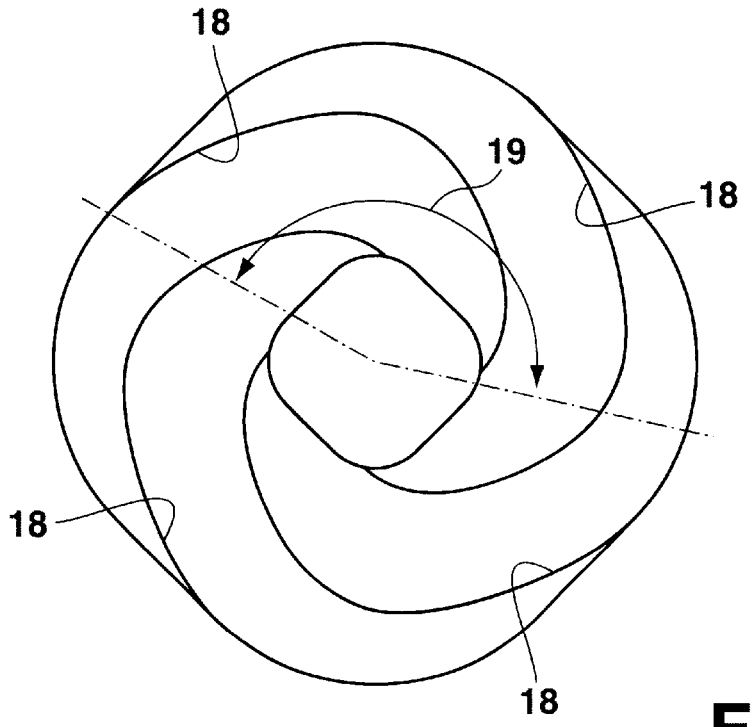
FIG. 3 shows a top view of a cycloid tooth construction with 4 cycloids and a spiral angle of approximately 170°.

FIG. 3 shows a simplified top view of the power component 1. Four spiral generating lines 18 are shown, illustrating the structure of the spiral cycloid teeth. The generating lines 18 are located at the apex points of the cycloids. In the example shown, the spiral angle 19 is approximately 170°.

Figure 4:
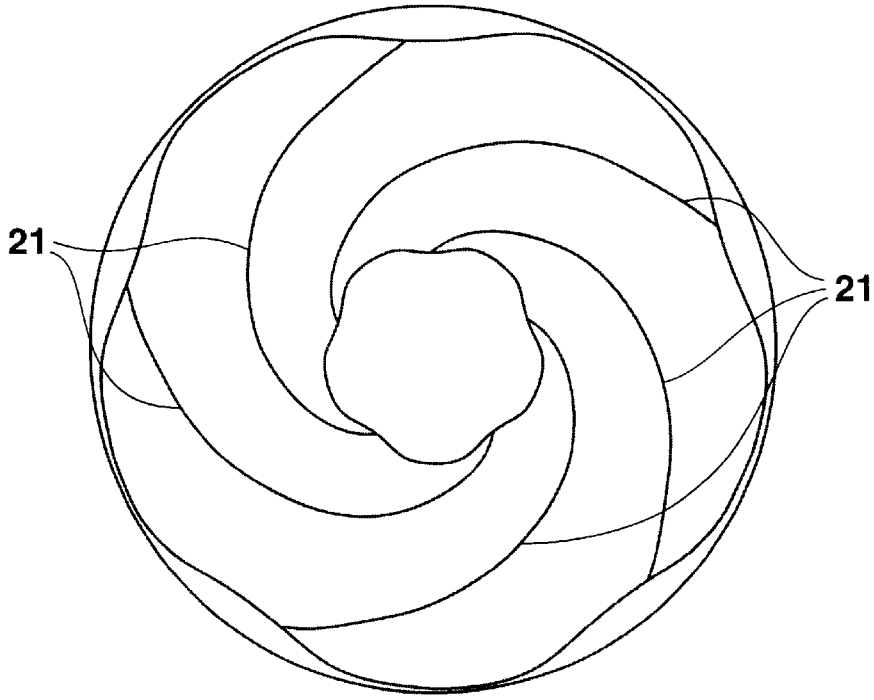
FIG. 4 shows a top view of a corresponding tooth construction of the blocking component with five teeth.

FIG. 4 shows the corresponding generating lines 21 for the blocking component 10. A comparison between FIG. 3 and FIG. 4 shows the difference in the number of teeth and illustrates the effect of the spiral tooth structure. In contrast to a straight cycloid tooth structure, the same working chamber may expand and compress simultaneously at its inner and outer regions. This facilitates a plurality of designs to obtain a desired volumetric behavior for the working chamber. When the spiral angle 19 subtended by the spiral generating line is greater than 360°, each working chamber 16 is temporarily closed at all sides during rotation of the power component 1 and the blocking component 10. Backflow of the working medium or other effects between the outlet and the inlet side or vice versa are thereby precluded.

Figure 5:
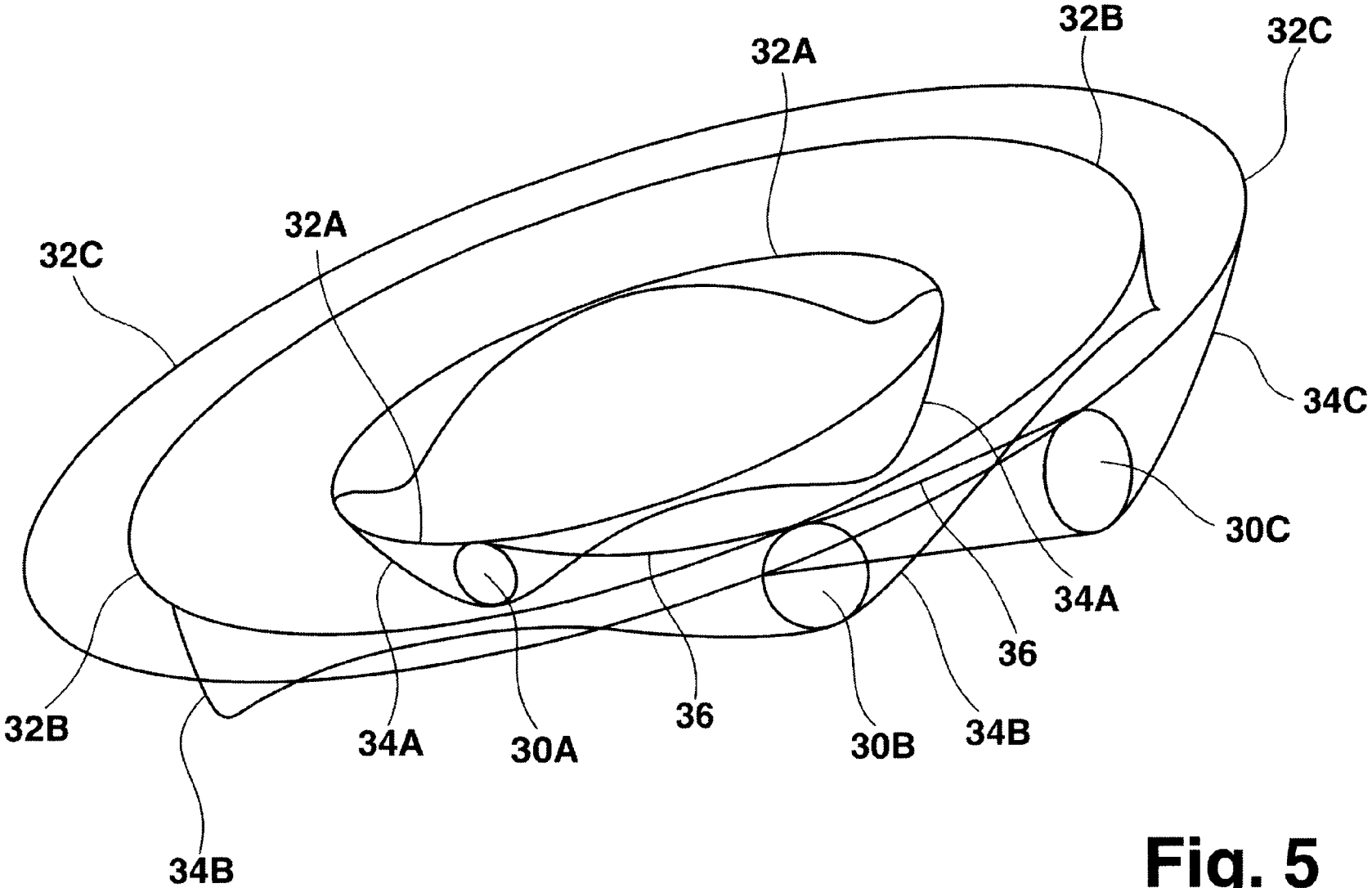
FIG. 5 shows a schematic illustration of the geometric means with which the structure of the cycloid teeth of the power component are generated.

FIG. 5 illustrates the manner in which the spiralling cycloid tooth structure of the power component is generated. The cycloid teeth are generated by rolling a circle 30A, 30B, 30C, along a respective base circular path 32A, 32B, 32C. As the respective circle 30A, 30B, 30C rolls along the respective base circular path 32A, 32B and 32C, an associated cycloid structure 32A, 32B, 32C is generated. By finely stepping the radius of the base circle 32A, 32B, 32C starting, for example, with the internal circle 32A, successive neighbouring cycloid shapes can be generated which can be smoothly connected to one another. The spiralling nature of the progressive cycloid structure when moving from the inner radial portion of the power component to the outer portion is determined by a generating spiral 36. With successively stepped radii for the base circles 32A, 32B and 32C, the generating spiral 36 determines the initial position of the respective rolling generating circle 30A, 30B, 30C which is offset relative to that of the neighbouring rolling generating circle 32A, 32B, 32C such that the neighbouring cycloids are shifted with respect to each other. Smooth connection of the neighbouring crests of cycloids generated on adjacent base circles 32A, 32B and 32C leads to a spiralling or curved cycloid tooth structure when moving from the inside of the power component towards the outside portion thereof. In the example of FIG. 5, only 3 such sweeps are shown for reasons of clarity. In actuality, small steps of increasing or decreasing radii are performed in order to smoothly generate non-linear, radially extending cycloid teeth on the power component.

Figure 6:
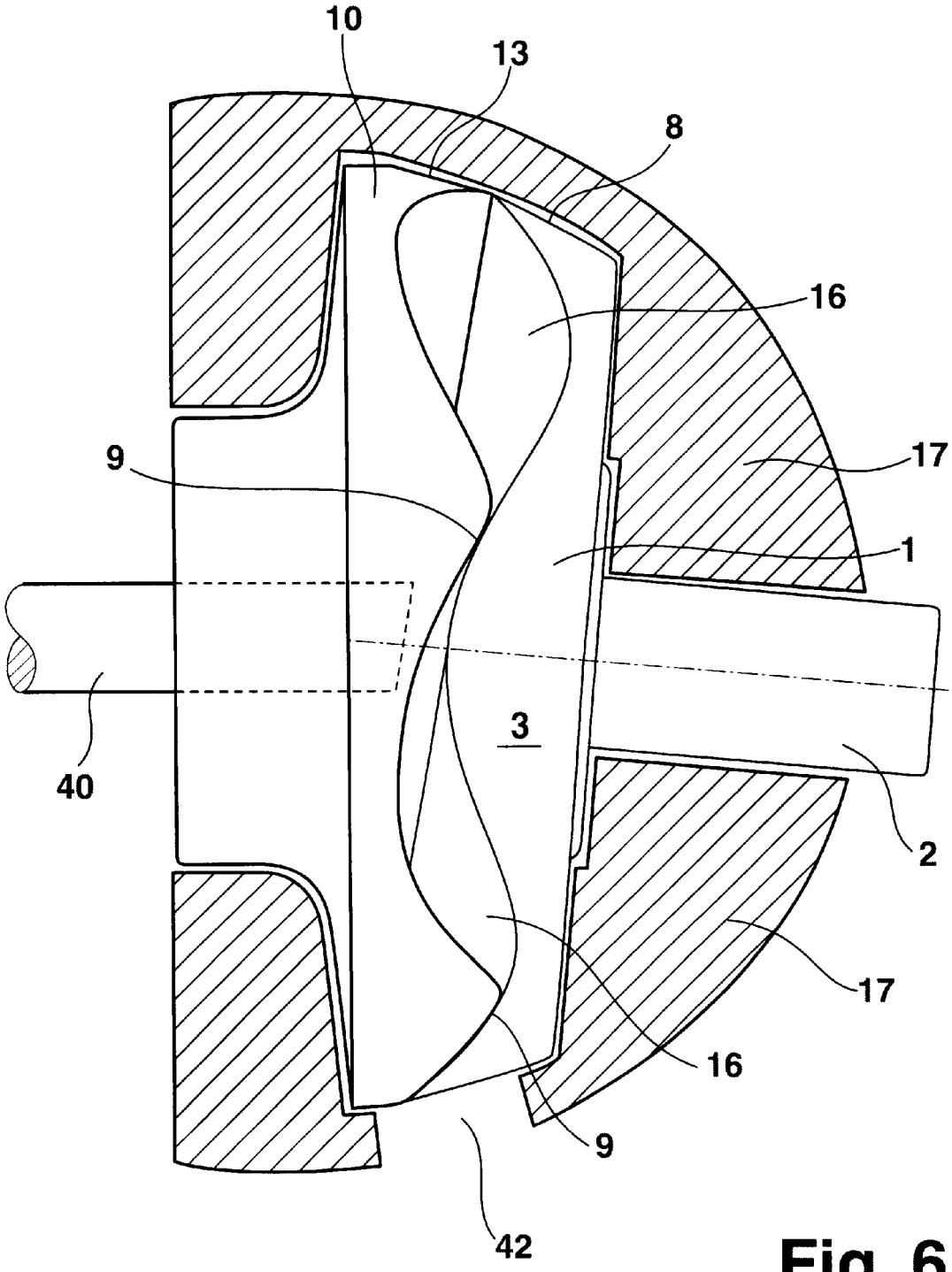
FIG. 6 shows a side view, partially cut, of the rotory piston machine of FIG. 2, indicating inlet and outlet openings.

FIG. 6 shows a partially cut side view of a power and blocking component of the embodiment in accordance with FIG. 2. The reference symbols here correspond to those of FIG. 2 and are therefore not further discussed. FIG. 6 shows the additional features of an inlet 40 and an outlet 42. In the embodiment of FIG. 6, the inlet extends axially through the central portion of the blocking component 10 to access the chambers 16 between the blocking component 10 and the power component 1 at a radially inward portion of the rotory piston machine. As the power 1 and blocking 10 components rotate, a medium passing through inlet 40 is transported from the inside to the radially outer portion of the rotory piston machine where it can be extracted at outlet 42. Outlet 42 can be confined to a certain peripheral region of the casing 17 of the rotory piston machine or extend through an annular region thereof.

Figure 7:
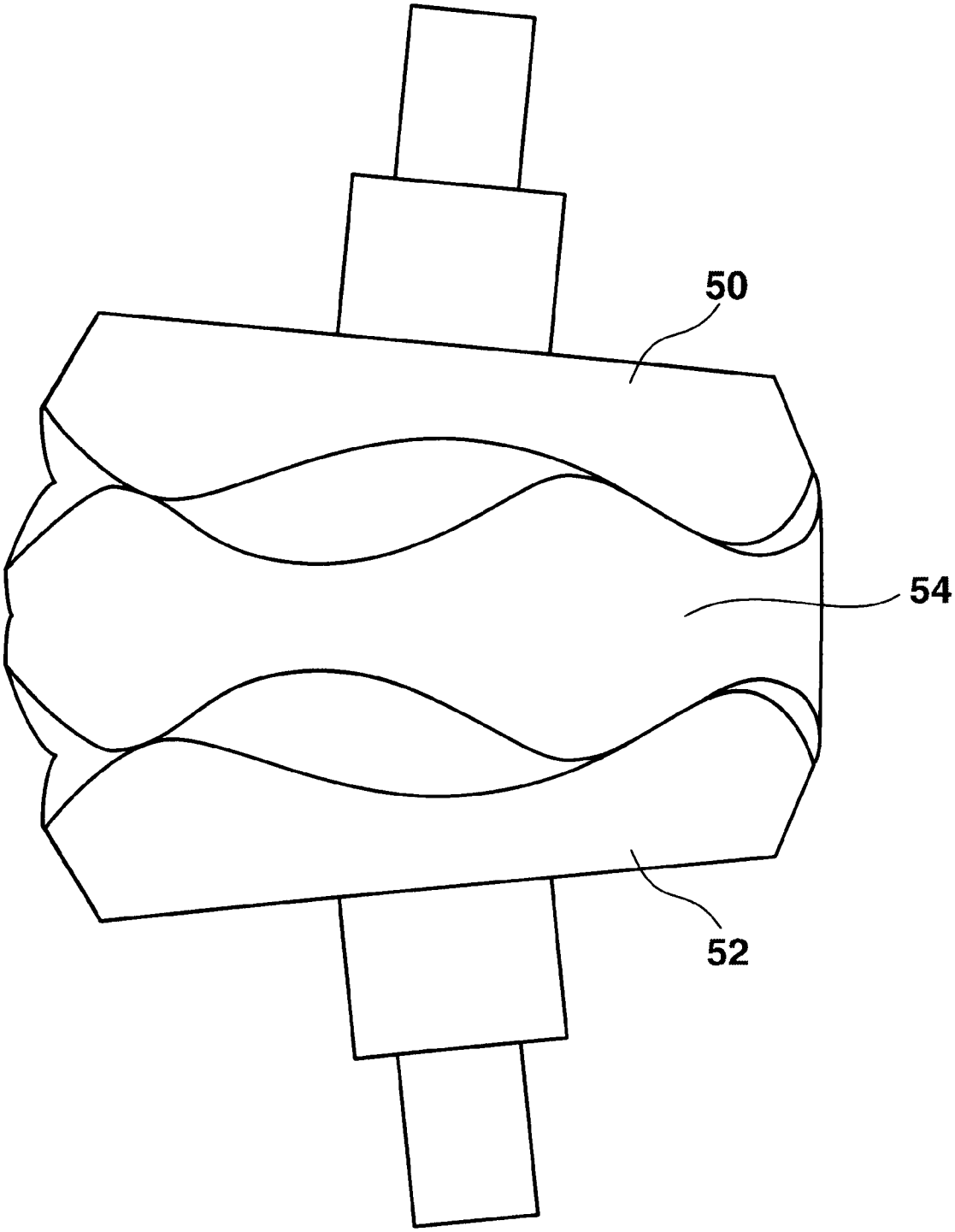
FIG. 7 shows a further embodiment of the rotary piston machine in accordance with the invention having upper and lower power components and an intermediate blocking component.

FIG. 7 shows an embodiment of the rotory piston machine in accordance with the invention having a first power component 50 and a second power component 52. These power components 50 and 52 engage blocking component 54 located between the respective cycloid surfaces of the first and second power components 50, 52. In the embodiment of FIG. 7, the power components 52 and 50 are disposed at an angle with respect to each other and the centrally disposed blocking component 54 is designed with teeth structures which are symmetric with respect to a plane extending through the central portion of the blocking component 54.

Figure 8:
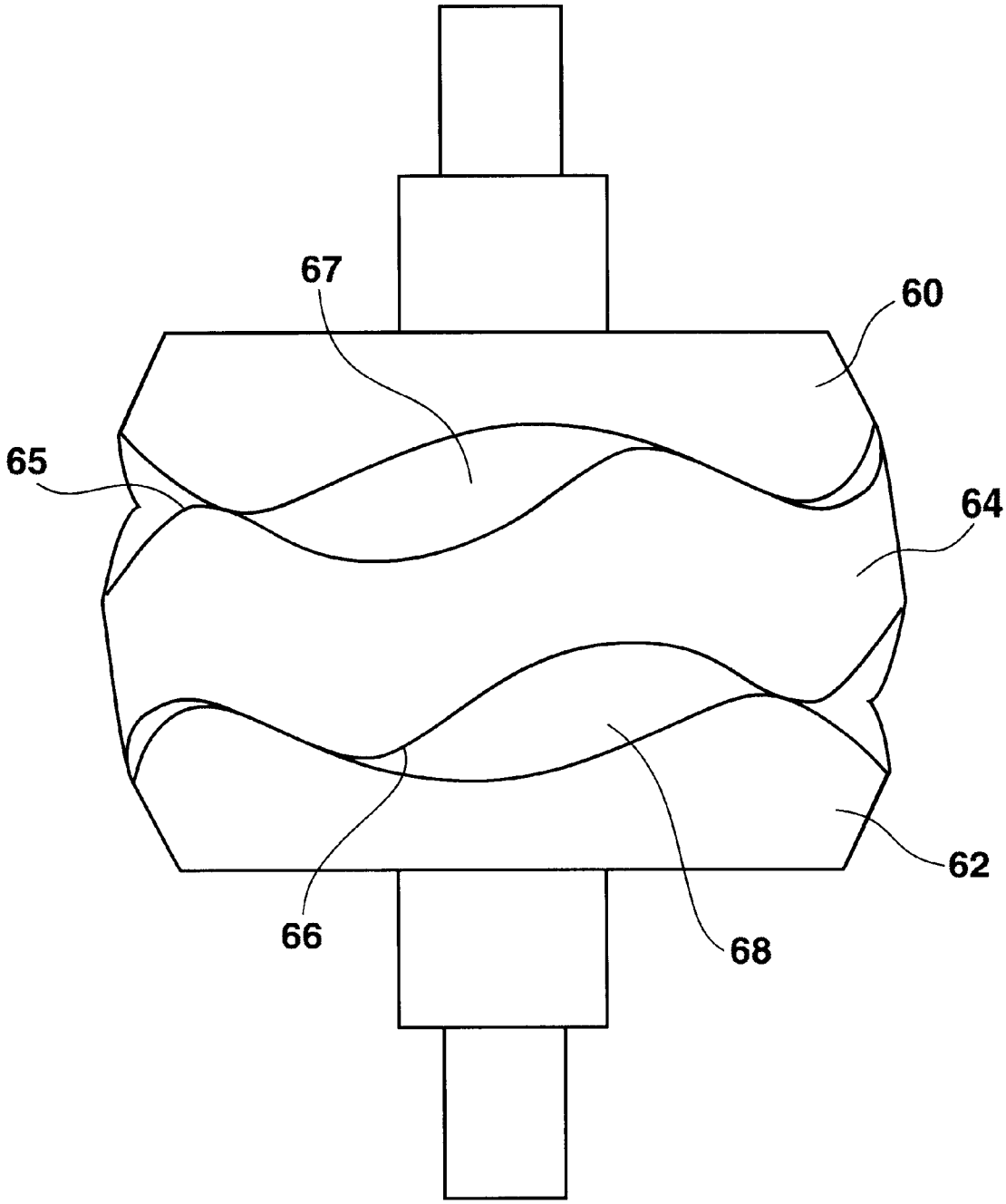
FIG. 8 shows another embodiment of the double power component single blocking component embodiment of FIG. 7, with co-linear orientation of the drive axes.

In the alternative embodiment of FIG. 8, the first power component 60 and a second power component 62 are configured to extend along a common vertical axis. In such embodiments, the blocking component 64 must be structured in such a fashion that an effective tilt symmetry axis is present with regard to the upper 65 and lower 66 teeth structure of the blocking component 64. In the embodiment of FIG. 8, the number of teeth 65 on the upper surface on the central blocking component 64 and the number of teeth 66 on the lower portion of the blocking component 64, are equal. Other embodiments are possible in which the number of upper teeth 65 and lower teeth 66 are different with respective differences in the cycloid formations on the first 60 and second 62 power components. Alternatively or in addition thereto, the tooth-like structures 65 and 66 can be displaced in angle with respect to each other. Both these features can be used to phase shift and change the time dependence of the transport behaviour of the rotory piston machines, in particular when adjacent or neighbouring chambers such as 67 and 68 are arranged such that the medium transported thereby are joined together in parallel.

Figure 9:
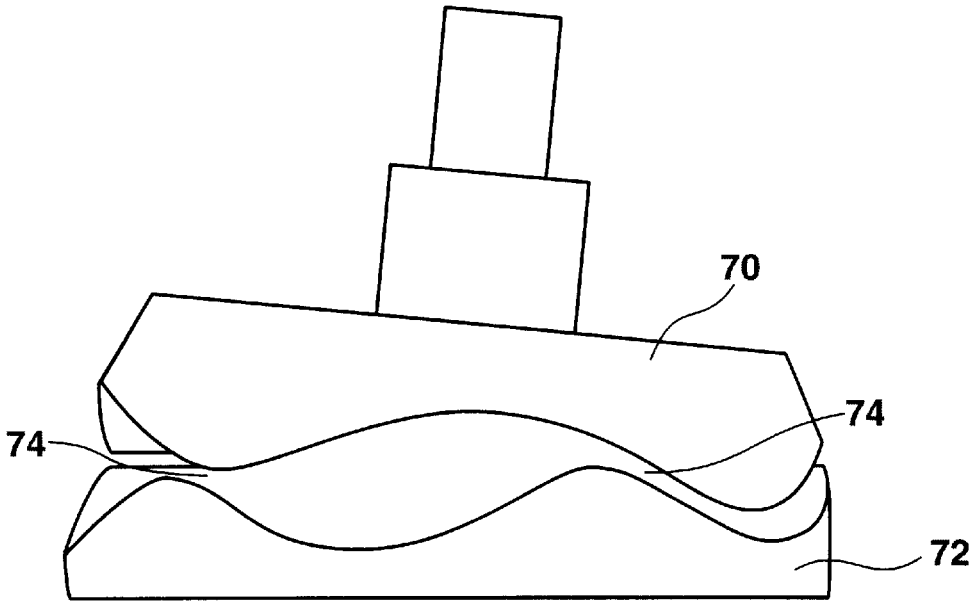
FIG. 9 shows a further embodiment of the invention indicating a gap between the power component and the blocking component.

In the embodiment of FIG. 9 the power component 70 is displaced with respect to the blocking component 72 to exhibit a gap 74. Such gaps can be extremely thin and be filled by the fluid medium being transported in the rotory piston machine. The size of the gap 74 can depend on the properties of fluid being transported (viscosity etc.).

Figure 10:
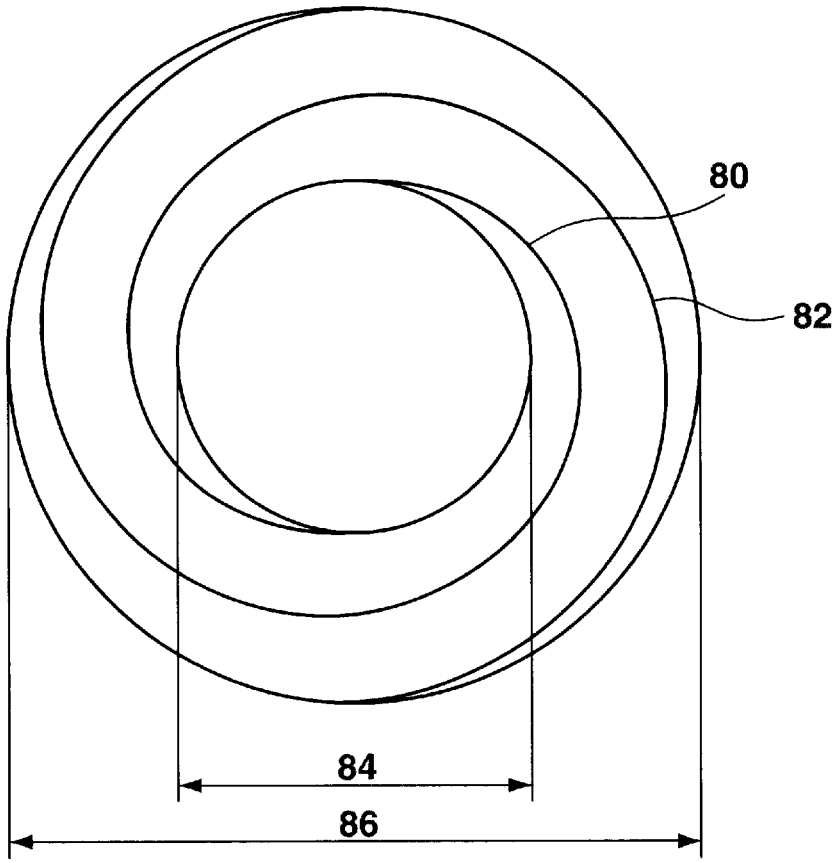
FIG. 10 shows a plan view onto the toothed portion of the power component, illustrating the spiral nature of the cycloid teeth with a spiral in excess of 360 degrees.

FIG. 10 shows a plan view of the cycloid tooth structured side of the power component. The spiral structure extends from an inner diameter 84 to an outer diameter 86 and displays spiralling crests 80 and 82 travelling through an angle of approximately 360 degrees while progressing from the inner radius 84 to the outer radius 86 of the power component. The structures 80 and 82 correspond to the spiral generating curve 36 of FIG. 5.

All the features shown in the description, the subsequent claims and the drawing may be essential to the invention individually or collectively in any arbitrary combination.

List of Reference Numbers

1 power component
2 drive or output shaft
3 spherical layer
4 base surface of the power component
5 end face of the power component
6 cycloid
7 line of intersection between spherical surface and base surface
8 spherical surface
9 sealing line between power component and blocking component
10 blocking component
11 shaft
12 base surface of the blocking component
13 spherical surface
14 end face of the blocking component
15 working angle
16 working chamber
17 casing
18 generating lines of the power component
19 spiral angle
20 —
21 generating lines of the blocking component
30A—first rolling generating circle
30B—second rolling generating circle
30C—third rolling generating circle
32A—first base circle
32B—second base circle
32C—third base circle
34A—first cycloid
34B—second cycloid
34C—third cycloid
36—generating spiral
40—inlet
42—outlet
50—first power component
52—second power component
54—blocking component
60—first power component
62—second power component
64—blocking component
65—upper teeth
66—lower teeth
67—upper chamber
68—lower chamber
70—power component
72—blocking component
74—gap
80—first generating spiral
82—second generating spiral
84—inner diameter
86—outer diameter

I claim:

1. A rotary piston machine for a pump, a compressor, a turbine or a motor, the machine comprising:

a casing having an inner spherical volume, and having at least one inlet and one outlet opening;

a power component having a first shaft supported in said casing and with one of a first drive and a first output device, said power component having a first spherical surface truncated by an first end face and a first base surface, said first spherical surface having a center lying in a first axis of rotation of said first shaft, said first spherical surface having a first diameter corresponding to an inner volume of said casing, wherein said first base surface is perpendicular to said first axis of rotation and said first end face is formed by the motion of a generating line, curved in a plane extending through said first axis and connected to a first point on said first axis, along a cycloid generating curve with at least 2 cycloids, wherein a circle generating said cycloids, rolls along a circular line of intersection between a plane parallel to said first base surface and said first spherical surface with a point on said circle forming said cycloids moving on said first spherical surface;

a blocking component connected to a second shaft supported in said casing, said blocking component having a second spherical surface truncated by a second end face and a second base surface, a center of said second spherical layer lying on a second axis of rotation of said second shaft, said second spherical surface having a diameter corresponding to said inner volume of said casing, said second base surface extending perpendicularly to said second axis, said second end face defining teeth cooperating in mating engagement with said power component, wherein the number of blocking component teeth differs from the number of power component cycloids by one, wherein said power component and said blocking component move synchronously about said first and said second axes, said first and said second shafts being disposed at a working angle with respect to one another, wherein working chambers are formed between said cycloids and said teeth which, with each rotation, pass through a defined maximum and minimum determined by said cycloids, a shape of said teeth and said working angle.

2. The rotary piston machine of claim 1, wherein said generating line is a spiral.

3. The rotary piston machine of claim 1, wherein said spiral has a spiral angle of at least approximately 360°.

4. The rotary piston machine of claim 1, wherein said working chambers are separated by a positive fit between said cycloids and said teeth of said blocking component.

5. The rotary piston machine of claim 1, wherein a defined separation is formed between said cycloids and said teeth.

6. The rotary piston machine of claim 1, wherein said inlet opening comprises an inlet control channel for entry of a working medium, said inlet control channel disposed on an inner diameter of said teeth, said outlet opening comprising an outlet control channel for output of said working medium, said outlet control channel disposed on an outer diameter of said teeth.

7. The rotary piston machine of claim 1, wherein said inlet opening comprises an inlet control channel for entry of a working medium, said inlet control channel disposed on outer diameter of said teeth, said outlet opening comprising an outlet control channel for output of said working medium, said outlet control channel disposed on an inner diameter of said teeth.

8. The rotary piston machine of claim 1, further comprising a second power component, wherein said blocking component is a disc having toothed operating surfaces on both sides thereof, said blocking component disposed between said power component and said second power component.

9. The rotary machine of claim 1, wherein said inlet and said outlet comprise channels for input and output of a working medium.

10. The rotary piston machine of claim 1, wherein said first and said second spherical surfaces are radially sealed against a spherical inner surface of said casing.

11. The rotary piston machine of claim 1, further comprising a second power component axially disposed in said casing, wherein said blocking component is disposed between said power component and said second power component, said blocking component having teeth on a first and a second side thereof, wherein a tooth structure of said blocking component on said first side is displaced in a direction of rotation relative to a tooth structure of said second side.

12. The piston machine of claim 1, further comprising a second blocking component, wherein said power component is a disc having toothed power operating surfaces on both sides thereof, said power component disposed between said blocking component and said second blocking component.

13. The rotary piston machine of claim 12, wherein two working chambers, disposed on either side of said disc, are connected to each another.

* * * * *